US005700075A

United States Patent [19]

Perone

[11] Patent Number: 5,700,075

[45] Date of Patent: Dec. 23, 1997

[54] BATTERY STORAGE AND DISPENSER APPARATUS

[76] Inventor: Robert N. Perone, 109 Nowlin Dr., Highland Village, Tex. 75067

[21] Appl. No.: 673,025

[22] Filed: Jul. 1, 1996

[51] Int. Cl.[6] ..... B65D 83/02; B65G 57/20

[52] U.S. Cl. ..... 312/45; 312/42; 312/114; 221/131

[58] Field of Search ..... 312/35, 45, 72, 312/42, 114; 221/131, 303, 309

[56] References Cited

U.S. PATENT DOCUMENTS

| | | | |
|---|---|---|---|
| D. 189,736 | 2/1961 | Combs | 312/45 X |
| D. 254,530 | 3/1980 | Armstrong | 312/45 X |
| 348,164 | 8/1886 | Judson . | |
| D. 353,735 | 12/1994 | English . | |
| 2,303,344 | 12/1942 | Erne | 312/42 X |
| 3,404,927 | 10/1968 | Mellion | 312/45 |
| 3,809,448 | 5/1974 | Rakaska | 312/45 X |
| 4,109,980 | 8/1978 | Brockman et al. . | |
| 4,530,548 | 7/1985 | Spamer et al. . | |
| 4,909,578 | 3/1990 | Abbate . | |
| 4,953,700 | 9/1990 | DeDino . | |
| 5,072,997 | 12/1991 | Mayfield, III . | |
| 5,447,253 | 9/1995 | Williams | 221/303 X |

FOREIGN PATENT DOCUMENTS

| | | | |
|---|---|---|---|
| 219258 | 3/1909 | Germany | 312/45 |
| 130379 | 2/1929 | Switzerland | 312/42 |

*Primary Examiner*—Jose V. Chen
*Assistant Examiner*—Hanh V. Tran

[57] ABSTRACT

A storage and dispenser apparatus includes a back wall panel and a first, a second, and a third side wall panel projecting outward from the back wall panel. The width of the third is greater than the width of the second side wall panel, and the width of the second is greater than the width of the first side wall panel. A first front wall panel is transparent and is connected between the first and the second side wall panels. A second front wall panel is transparent and is connected between the second and the third side wall panels. A bottom portion is connected to the back wall panel. The bottom portion extends below the respective front wall panels for providing a first dispensing gap between the first front wall panel and the bottom portion and for providing a second dispensing gap between the second front wall panel and the bottom portion. The back wall panel includes installation apertures. The bottom portion includes a first retention tray in registration with the first dispensing gap and includes first retention walls and a first article-access notch located between the first retention walls. The bottom portion includes a second retention tray in registration with the second dispensing gap. The second retention tray is deeper than the first retention tray. The second retention tray includes second retention walls and a second article-access notch located between the second retention walls. Additional side walls, front wall panels, and retention trays can also be provided.

3 Claims, 3 Drawing Sheets

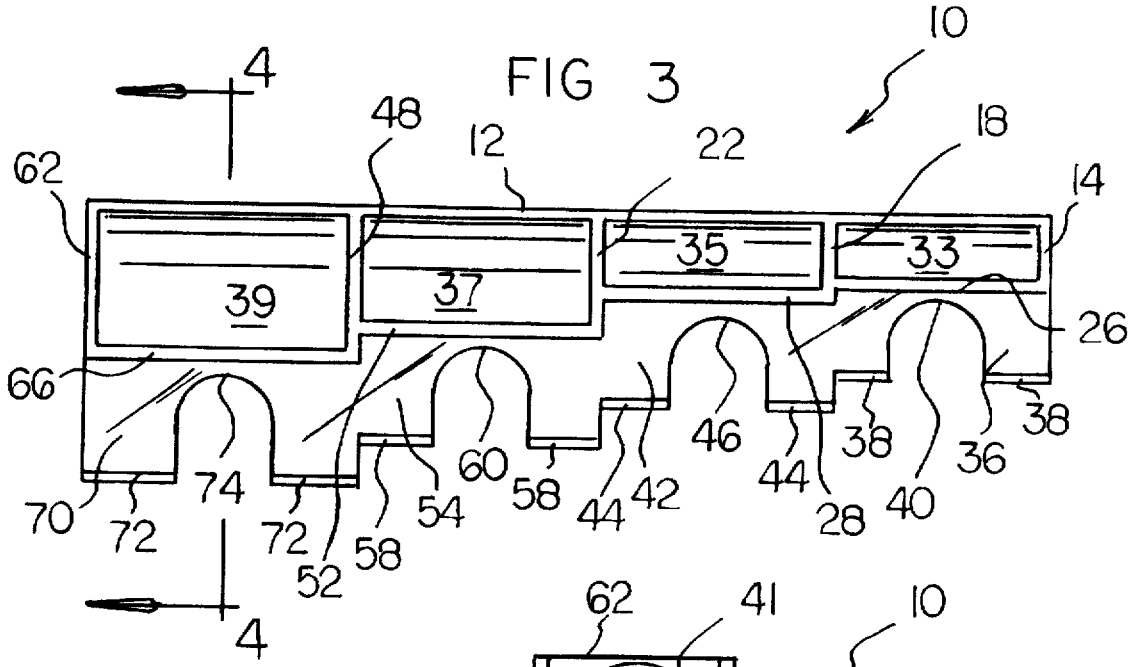
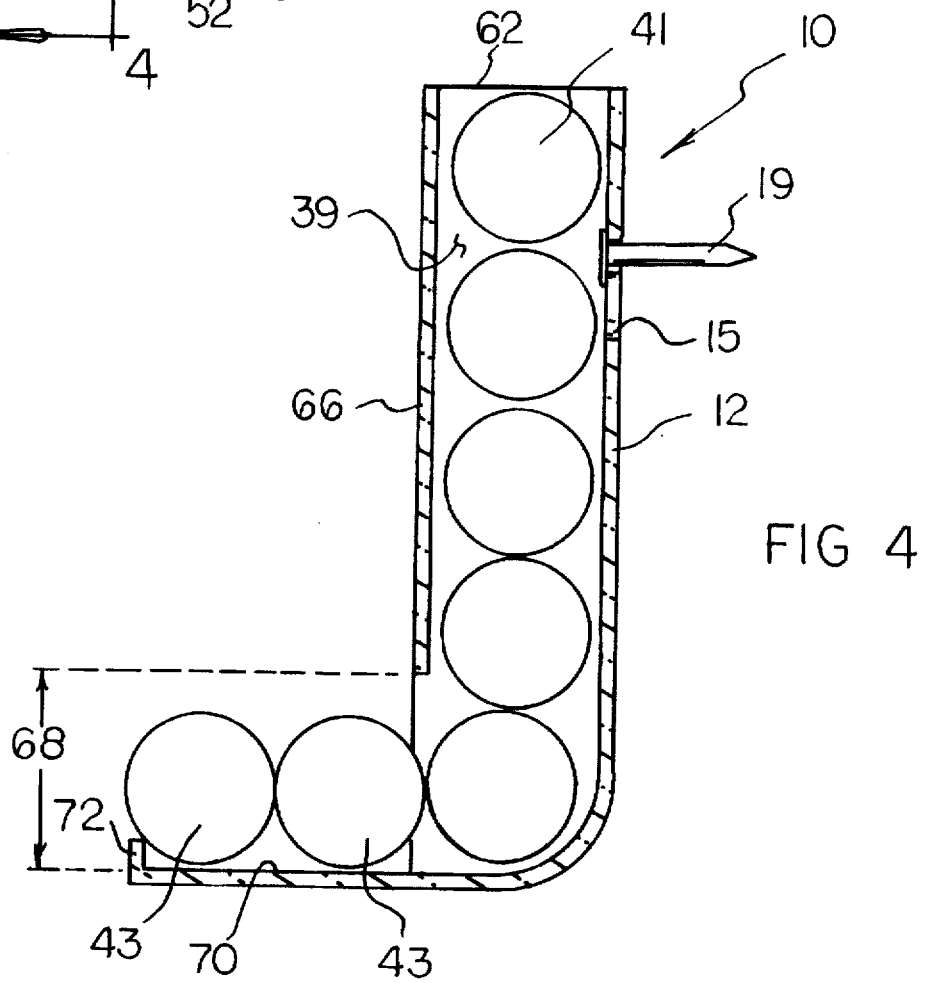
FIG 4

BATTERY STORAGE AND DISPENSER APPARATUS

BACKGROUND OF THE INVENTION

1. Field of the Invention

The present invention relates generally to storage and dispenser devices and, more particularly, to a storage and dispenser device especially adapted for storing and dispensing batteries having a variety of sizes.

2. Description of the Prior Art

Batteries that are used for powering battery-powered devices come in a variety of sizes, such as size D, size C, size AA, and size AAA. So that the right size battery is available when needed, it is desirable for a person to retain a number of batteries in storage so that they are readily available when needed. In this regard, U.S. Pat. No. 4,109,980 discloses a home battery storage and dispenser apparatus which stores and dispenses a variety of battery sizes. More specifically, in U.S. Pat. No. 4,109,980, size D, size C, and size AA batteries are stored in vertical magazines that have medially disposed viewing slots in the front magazine walls that enable a person to observe how many batteries are in the magazine. However, the side edges of the front walls of these magazines are opaque. With such magazines, the center portions of the batteries are visible, but the ends of the batteries are not visible. It is noted, however, that when a battery deteriorates, it is often at one or both of the ends that leakage, corrosion, or other signs of deterioration are visible. Therefore, to enable a person to observe visible signs of battery deterioration at the ends of batteries, it would be desirable if the side edges of the front wall of a battery storage magazine were transparent to enable a person to view ends of the batteries stored in the magazine.

Another aspect of U.S. Pat. No. 4,109,980 is worthy of discussion. It is noted that each battery storage magazine has two side walls. There are seven battery storage magazines, and there are fourteen magazine side walls. This is so because each of the magazines is separated from the other magazines. To make for a more compact battery storage and dispenser device and to require less fabrication material in making the device, it would be desirable if a plurality of battery storage magazines were arranged in a contiguous sequence so that adjacent battery magazines share a common wall.

In addition, with respect to U.S. Pat. No. 4,109,980, it is noted that respective stop elements, associated with the magazines for size D, size C, and size AA batteries, are medially located with respect to the respective magazines. As a result, when a person removes a battery from the device, it is most convenient for the person to grasp the battery at the ends of the battery. As mentioned above, batteries often deteriorate at their ends. Moreover, it is well known that the human body is a conductor of electricity. Therefore, when a person grasps a battery at both of its ends, some of the power in the battery may discharge through the person's body. This is so because in size D, size C, and size AA batteries, the battery posts are located at the ends of the batteries. In view of these considerations, it would be desirable if it were most convenient to remove a battery from a battery storage and dispenser device by grasping the battery on its side, away from its ends.

As a matter of interest, throughout the years, a number of innovations have been developed relating to storing and dispensing articles, and the following U.S. patents are representative of some of those innovations: U.S. Pat. Nos. 4,530,548, 4,909,578, 4,953,700, 5,072,997, and U.S. Des. Pat. No. 353,735.

Thus, while the foregoing body of prior art indicates it to be well known to use storage and dispenser devices for articles, the prior art described above does not teach or suggest a battery storage and dispenser apparatus which has the following combination of desirable features: (1) enables a person to retain a number of batteries in storage so that they are readily available when needed; (2) has transparent side edges of the front wall of a battery storage magazine to enable a person to view ends of the batteries stored in the magazine; (3) has a plurality of battery storage magazines arranged in a contiguous sequence so that adjacent battery magazines share a common wall; and (4) provides for removal of a battery from a battery storage and dispenser device by grasping the battery on its side, away from its ends. The foregoing desired characteristics are provided by the unique battery storage and dispenser apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a storage and dispenser apparatus which includes a back wall panel and a first side wall panel projecting outward from the back wall panel. The first side wall panel has a first side wall panel width. A second side wall panel projects outward from the back wall panel. The second side wall panel has a second side wall panel width which is greater than the first side wall panel width. A third side wall panel projects outward from the back wall panel. The third side wall panel has a third side wall panel width. The third side wall panel width is greater than the first side wall panel width. A first front wall panel is connected between the first side wall panel and the second side wall panel. The first front wall panel includes transparent edge portions. A second front wall panel is connected between the second side wall panel and the third side wall panel. The second front wall panel includes transparent edge portions. A bottom portion is connected to the back wall panel. The bottom portion extends below the respective front wall panels for providing a first dispensing gap between the first front wall panel and the bottom portion and for providing a second dispensing gap between the second front wall panel and the bottom portion. The back wall panel includes installation apertures.

The bottom portion includes a first retention tray in registration with the first dispensing gap. The first retention tray includes first retention walls and a first article-access notch located between the first retention walls. The bottom portion includes a second retention tray in registration with the second dispensing gap. The second retention tray is deeper than the first retention tray. The second retention tray includes second retention walls and a second article-access notch located between the second retention walls. A fourth side wall panel projects outward from the back wall panel. The fourth side wall panel has a fourth side wall panel width. A third front wall panel is connected between the fourth side wall panel and the third side wall panel. The third front wall panel includes transparent edge portions.

The bottom portion extends below the third front wall panel for providing a third dispensing gap between the third front wall panel and the bottom portion. The third dispensing gap is greater than the second dispensing gap. The bottom portion includes a third retention tray in registration with the third dispensing gap. The third retention tray is deeper than the second retention tray. The third retention tray includes third retention walls and a third article-access notch located between the third retention walls.

A fifth side wall panel projects outward from the back wall panel. The fifth side wall panel has a fifth side wall panel width. A fourth front wall panel is connected between the fifth side wall panel and the fourth side wall panel. The fourth front wall panel includes transparent edge portions.

The bottom portion extends below the fourth front wall panel for providing a fourth dispensing gap between the fourth front wall panel and the bottom portion. The fourth dispensing gap is greater than the third dispensing gap. The bottom portion includes a fourth retention tray in registration with the fourth dispensing gap. The fourth retention tray is deeper than the third retention tray. The fourth retention tray includes fourth retention walls and a fourth article-access notch located between the fourth retention walls.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved battery storage and dispenser apparatus which has all of the advantages of the prior art and none of the disadvantages.

It is another object of the present invention to provide a new and improved battery storage and dispenser apparatus which may be easily and efficiently manufactured and marketed.

It is a further object of the present invention to provide a new and improved battery storage and dispenser apparatus which is of durable and reliable construction.

An even further object of the present invention is to provide a new and improved battery storage and dispenser apparatus which is susceptible of a low cost of manufacture with regard to both materials and labor, and which accordingly is then susceptible of low prices of sale to the consuming public, thereby making such battery storage and dispenser apparatus available to the buying public.

Still yet a further object of the present invention is to provide a new and improved battery storage and dispenser apparatus which enables a person to retain a number of batteries in storage so that they are readily available when needed.

Still another object of the present invention is to provide a new and improved battery storage and dispenser apparatus that has transparent side edges of the front wall of a battery storage magazine to enable a person to view ends of the batteries stored in the magazine.

Yet another object of the present invention is to provide a new and improved battery storage and dispenser apparatus which has a plurality of battery storage magazines arranged in a contiguous sequence so that adjacent battery magazines share a common wall.

Even another object of the present invention is to provide a new and improved battery storage and dispenser apparatus that provides for removal of a battery from a battery storage and dispenser device by grasping the battery on its side, away from its ends.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a top view of the embodiment of the battery storage and dispenser apparatus shown in FIGS. 1 and 2.

FIG. 4 is an enlarged cross-sectional view of the embodiment of the battery storage and dispenser apparatus of FIG. 3 taken along line 4—4 thereof.

DESCRIPTION OF THE PREFERRED EMBODIMENT

With reference to the drawings, a new and improved battery storage and dispenser apparatus embodying the principles and concepts of the present invention will be described.

Figure 1:
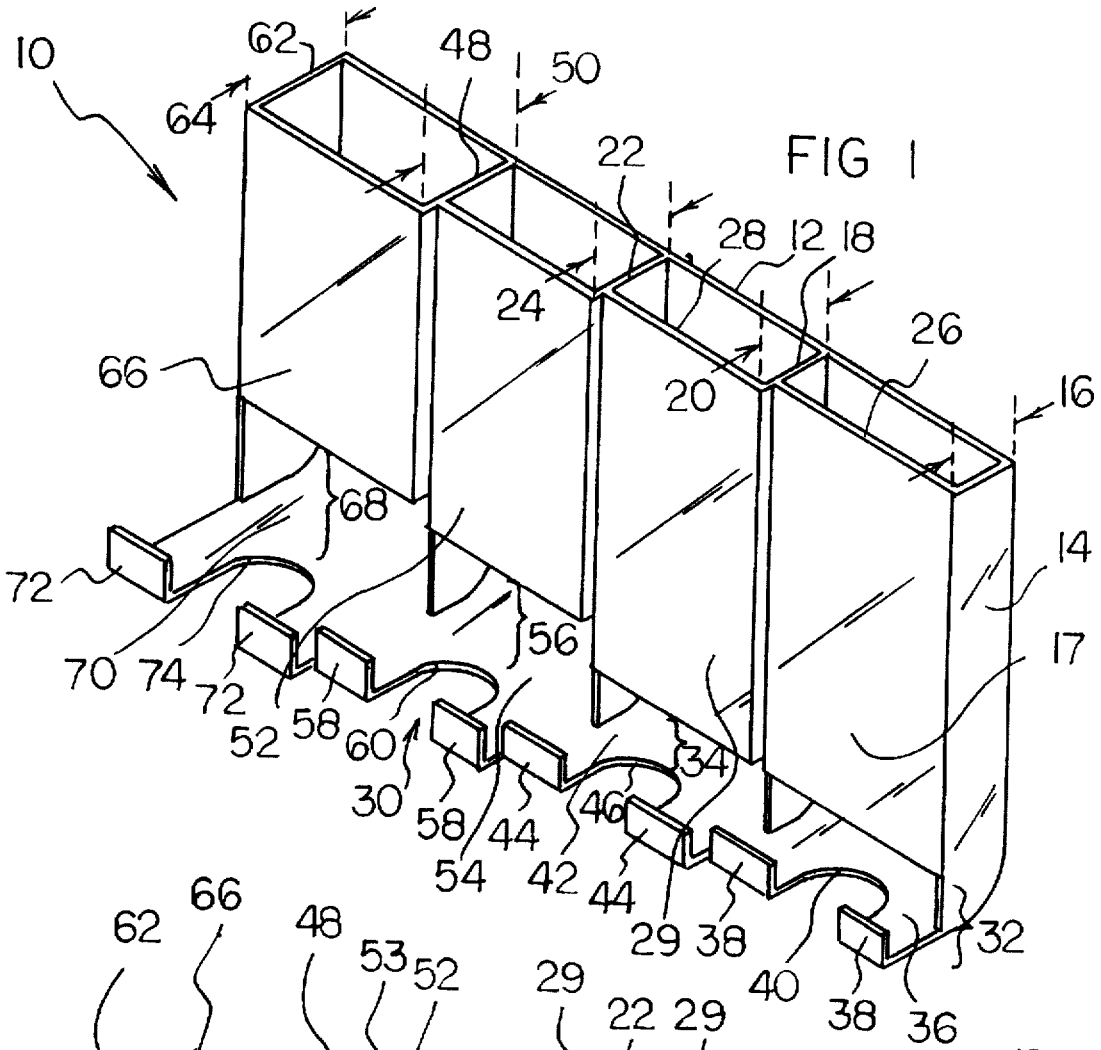
FIG. 1 is a front perspective view showing a preferred embodiment of the battery storage and dispenser apparatus of the invention.
Figure 2:
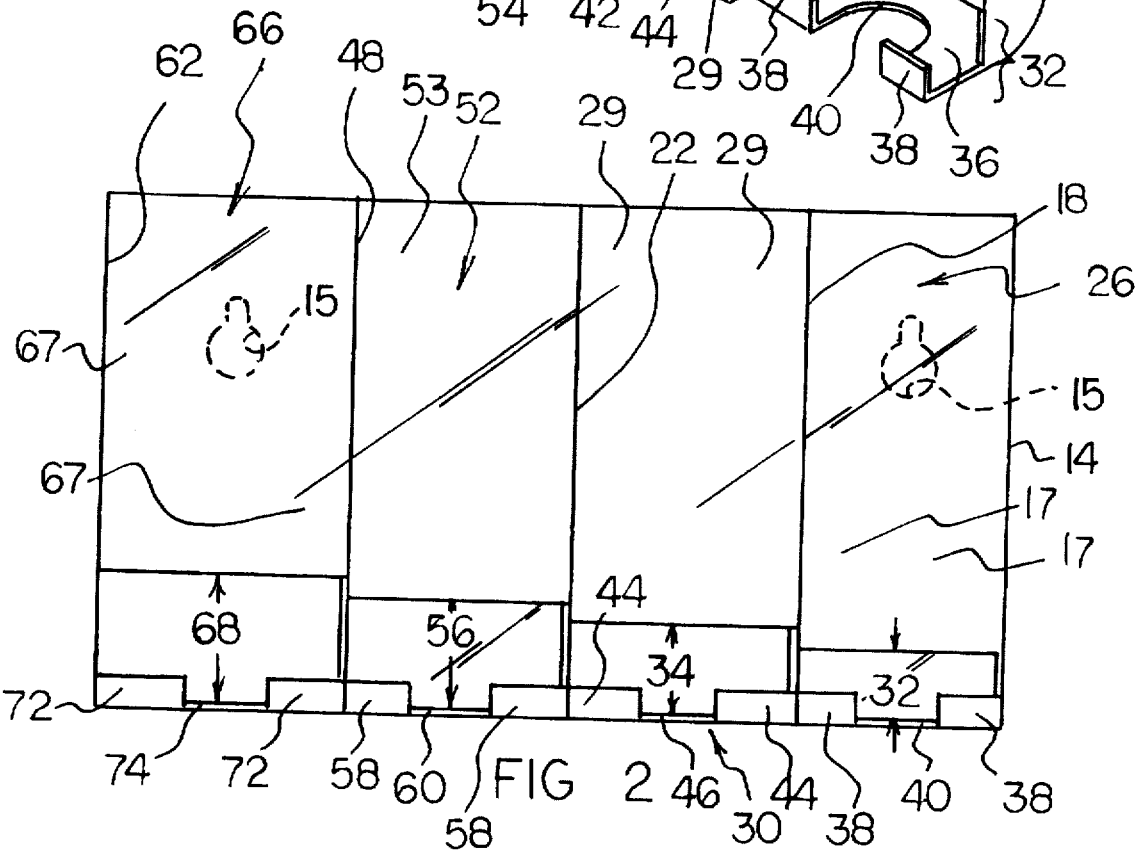
FIG. 2 is a front view of the embodiment of the battery storage and dispenser apparatus shown in FIG. 1.
Figure 5:
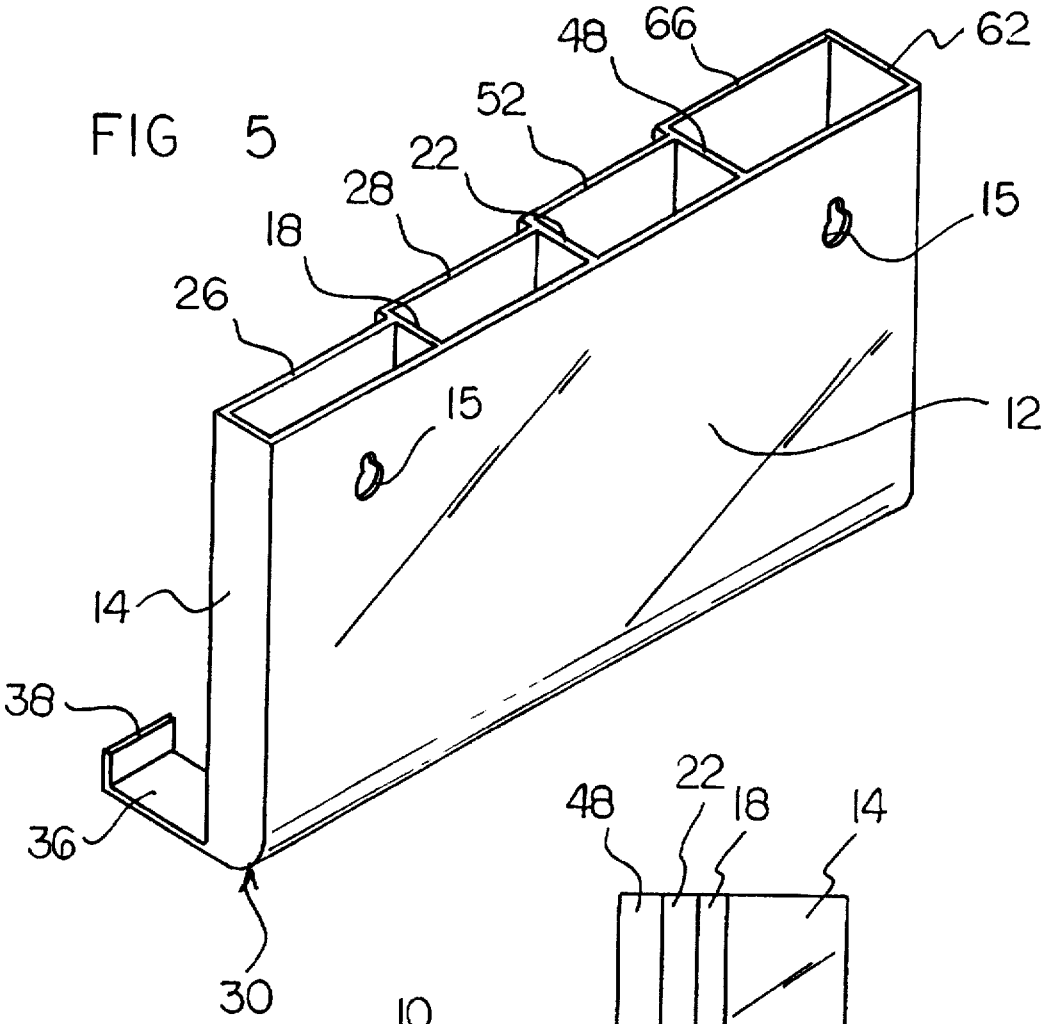
FIG. 5 is a rear perspective view of the embodiment of the invention shown in FIGS. 1, 2, and 3.
Figure 6:
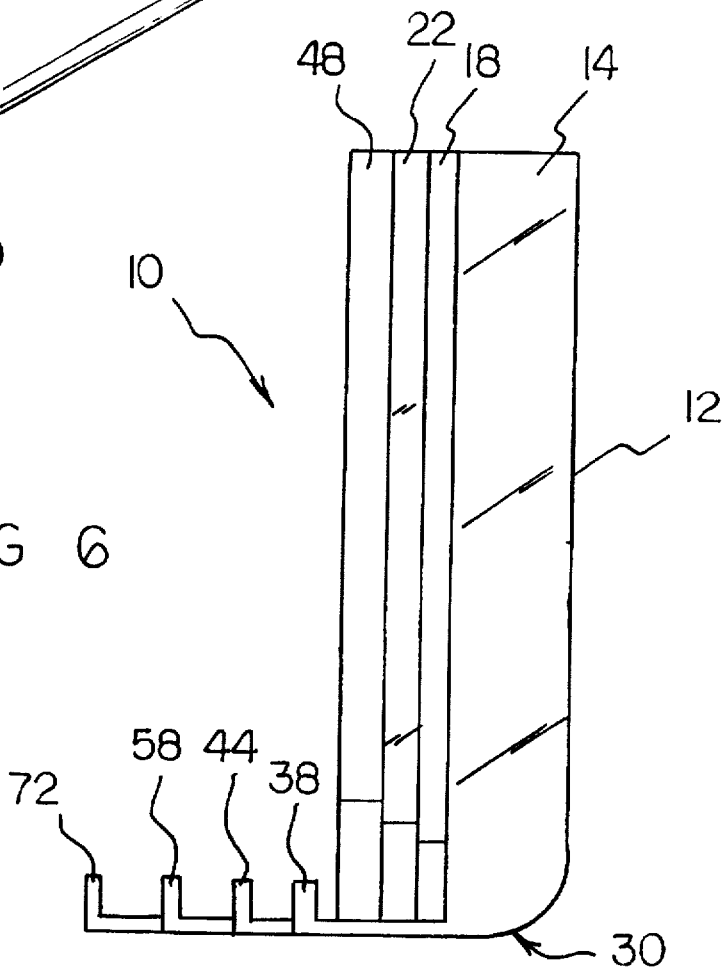
FIG. 6 is a side view of the embodiment of the invention shown in FIGS. 1, 2, 3, and 5.

Turning to FIGS. 1–6, there is shown an exemplary embodiment of an article storage and dispenser apparatus of the invention generally designated by reference numeral 10. In its preferred form, article storage and dispenser apparatus 10 includes a back wall panel 12 and a first side wall panel 14 projecting outward from the back wall panel 12. The first side wall panel 14 has a first side wall panel width 16. A second side wall panel 18 projects outward from the back wall panel 12. The second side wall panel 18 has a second side wall panel width 20 which is greater than the first side wall panel width 16. A third side wall panel 22 projects outward from the back wall panel 12. The third side wall panel 22 has a third side wall panel width 24. The third side wall panel width 24 is greater than the first side wall panel width 16. A first front wall panel 26 is connected between the first side wall panel 14 and the second side wall panel 18. The first front wall panel 26 includes transparent edge portions 17. A second front wall panel 28 is connected between the second side wall panel 18 and the third side wall panel 22. The second front wall panel 28 includes transparent edge portions 29. A bottom portion 30 is connected to the back wall panel 12. The bottom portion 30 extends below the respective front wall panels for providing a first dispensing gap 32 between the first front wall panel 26 and the bottom portion 30 and for providing a second dispensing gap 34 between the second front wall panel 28 and the bottom portion 30.

Preferably, the first front wall panel 26 is coupled to a first side wall outer edge of the first side wall panel 14. The first front wall panel 26 is also coupled to the second side wall panel 18 at a point spaced from a second side wall outer edge to define an exterior second side wall viewing window and an interior second side wall viewing window (not labeled) separated by the first front wall panel. Similarly, the second front wall panel 28 is coupled to a second side wall outer edge of the second side wall panel 18. The second front wall panel 28 is also coupled to the third side wall panel 22 at a point spaced from a third side wall outer edge to define an exterior third side wall viewing window and an interior third side wall viewing window separated by the second front wall panel (not labeled).

The back wall panel 12 includes installation apertures 15. The apertures 15 are used for receiving fasteners, such as nails 19, for installing the storage and dispenser apparatus 10 to a vertical surface such as a wall.

The bottom portion 30 includes a first retention tray 36 in registration with the first dispensing gap 32. The first retention tray 36 includes first retention walls 38 and a first article-access notch 40 located between the first retention walls 38. The bottom portion 30 includes a second retention tray 42 in registration with the second dispensing gap 34. The second retention tray 42 is deeper than the first retention tray 36. The second retention tray 42 includes second retention walls 44 and a second article-access notch 46 located between the second retention walls 44. A fourth side wall panel 48 projects outward from the back wall panel 12. The fourth side wall panel 48 has a fourth side wall panel width 50. A third front wall panel 52 is connected between the fourth side wall panel 48 and the third side wall panel 22. The third front wall panel 52 includes transparent edge portions 53.

The bottom portion 30 extends below the third front wall panel 52 for providing a third dispensing gap 56 between the third front wall panel 52 and the bottom portion 30. The third dispensing gap 56 is greater than the second dispensing gap 34.

The bottom portion 30 includes a third retention tray 54 in registration with the third dispensing gap 56. The third retention tray 54 is deeper than the second retention tray 42. The third retention tray 54 includes third retention walls 58 and a third article-access notch 60 located between the third retention walls 58.

A fifth side wall panel 62 projects outward from the back wall panel 12. The fifth side wall panel 62 has a fifth side wall panel width 64. A fourth front wall panel 66 is connected between the fifth side wall panel 62 and the fourth side wall panel 48. The fourth front wall panel 66 includes transparent edge portions 67.

The bottom portion 30 extends below the fourth front wall panel 66 for providing a fourth dispensing gap 68 between the fourth front wall panel 66 and the bottom portion 30. The fourth dispensing gap 68 is greater than the third dispensing gap 56. The bottom portion 30 includes a fourth retention tray 70 in registration with the fourth dispensing gap 68. The fourth retention tray 70 is deeper than the third retention tray 54. The fourth retention tray 70 includes fourth retention walls 72 and a fourth article-access notch 74 located between the fourth retention walls 72.

In using the storage and dispenser apparatus 10 of the invention, a first magazine 33 is defined by the back wall panel 12, the first side wall panel 14, the first front wall panel 26, and the second side wall panel 18. A second magazine 35 is defined by the back wall panel 12, the second side wall panel 18, the second front wall panel 28, and the third side wall panel 22. A third magazine 37 is defined by the back wall panel 12, the third side wall panel 22, the third front wall panel 52, and the fourth side wall panel 48. A fourth magazine 39 is defined by the back wall panel 12, the fourth side wall panel 48, the fourth front wall panel 66, and the fifth side wall panel 62. The first magazine is for holding the smallest articles, e.g. size AAA batteries. The second magazine can hold larger articles, e.g. size AA batteries. The third magazine can hold still larger articles, e.g. size C batteries. The fourth magazine can hold still larger articles, e.g. size D batteries.

It is noted that, in sequence, the fourth side wall panel width 50 is larger than the third side wall panel width 24 which is larger than the second side wall panel width 20 which is larger than the first side wall panel width 16. As a result, the fourth magazine has a greater width than the third magazine which has a greater width than the second magazine which has a greater width than the first magazine. Moreover, the length of the fourth front wall panel 66 accommodates the length of the size D batteries. The length of the third front wall panel 52 accommodates the length of the size C batteries. The length of the second front wall panel 28 accommodates the length of the size AA batteries. The length of the first front wall panel 26 accommodates length of the size AAA batteries.

In addition, the height of the fourth dispensing gap 68 is greater than the height of the third dispensing gap 56 and accommodates the diameter of the size D batteries. The height of the third dispensing gap 56 is greater than the height of the second dispensing gap 34 and accommodates the diameter of the size C batteries. The height of the second dispensing gap 34 is greater than the height of the first dispensing gap 32 and accommodates the diameter of the size AA batteries. The height of the first dispensing gap 32 accommodates the diameter of the size AAA batteries.

Furthermore, the fourth retention tray 70 is deeper than the depth of the third retention tray 54 and accommodates size D batteries. The third retention tray 54 is deeper than the depth of the second retention tray 42 and accommodates size C batteries. The second retention tray 42 is deeper than the depth of the first retention tray 36 and accommodates size AA batteries. The first retention tray 36 is the least deep tray and accommodates size AAA batteries.

As shown in FIG. 4, the storage and dispenser apparatus 10 can be installed on a vertical wall using a nails 19, and the storage and dispenser apparatus 10 is supported by the nails 19 using the installation apertures 15 in the back wall panel 12. A plurality of size D batteries 41 are loaded through the top into the fourth magazine 39. Being pushed by the batteries 41 in the fourth magazine 39, two batteries 43 are pushed onto the fourth retention tray 70 and are retained by the fourth retention walls 72. When a battery 43 is to be removed from the fourth retention tray 70, a person can place two fingers in the fourth article-access notch 74 to grasp the center of the battery 43 pressed against the fourth retention walls 72. Then, this battery 43 is lifted up and over the fourth retention walls 72. After this battery is removed from the fourth retention tray 70, the other batteries, under the influence of gravity, are moved toward the fourth retention walls 72, and their movement is stopped by the retention walls. Loading and dispensing from the other magazines is done in substantially the same way as described above for the fourth magazine 39.

The components of the battery storage and dispenser apparatus of the invention can be made from inexpensive and durable plastic materials, preferably transparent plastic materials. When the storage and dispenser apparatus 10 is made from transparent plastic, not only the side edges of the front walls are transparent, but the entire apparatus is transparent.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved battery storage and dispenser apparatus that is low in cost, relatively simple in design and operation, and which may advantageously be used to enable a person to retain a number of batteries in storage so that they are readily available when needed. With the invention, a battery storage and dispenser apparatus is provided which has transparent side edges of the front wall of a battery storage magazine to enable a person to view ends of the batteries stored in the magazine. With the invention, a battery storage and dispenser apparatus is provided which has a plurality of battery storage magazines arranged in a contiguous sequence so that adjacent battery magazines share a common wall. With the invention, a battery storage and dispenser apparatus provides for removal of a battery from a battery storage and dispenser device by grasping the battery on its side, away from its ends.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use. For example, although the preferred embodiment described above contemplates convenient battery storage for batteries of different size and/or capacity, it will be appreciated that a battery storage and dispenser apparatus according to the present invention with only a single size/type battery (e.g. all AA batteries) may also be practiced without departing from the broad principles hereof. Further, it is to be understood that the battery storage and dispenser apparatus of the invention with suitable modification may be placed in a conventional refrigerator or similar low temperature environment to prolong the life of the batteries stored therein.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the propose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A storage and dispenser apparatus comprising:

a back wall panel;

a transparent first side wall panel projecting outward from said back wall panel, said first side wall panel having a first side wall outer edge and a first side wall panel width;

a transparent second side wall panel projecting outward from said back wall panel, said second side wall panel having a second side wall outer edge and a second side wall panel width which is greater than said first side wall panel width;

a transparent third side wall panel projecting outward from said back wall panel, said third side wall panel having a third wall outer edge and a third side wall panel width, wherein said third side wall panel width is greater than said second side wall panel width;

a transparent fourth side wall panel projecting outward from said back wall panel, said fourth side wall panel having a fourth side wall outer edge and a fourth side wall panel width, wherein said fourth side wall panel width is greater than said second side wall panel width;

a transparent first front wall panel extending between said first side wall panel and said second side wall panel, said first front wall panel being coupled to said first side wall outer edge of said first side wall panel, said first front wall panel being coupled to said second side wall panel at a point spaced from said second side wall outer edge to define an exterior second side wall viewing window and an interior second side wall viewing window separated by said first front wall panel;

a transparent second front wall panel extending between said second side wall panel and said third side wall panel, said second front wall panel being coupled to said second side wall outer edge of said second side wall panel, said second front wall panel being coupled to said third side wall panel at a point spaced from said third side wall outer edge to define an exterior third side wall viewing window and an interior third side wall viewing window separated by said second front wall panel;

a transparent third front wall panel extending between said third side wall panel and said fourth side wall panel, said third front wall panel being coupled to said third side wall outer edge of said third side wall panel;

a bottom portion connected to said back wall panel, wherein said bottom portion extends below said respective front wall panels to define a first dispensing gap between said first front wall panel and said bottom portion, a second dispensing gap between said second front wall panel and said bottom portion, and a third dispensing gap between said third front wall panel and said bottom portion.

2. The apparatus of claim 1 wherein said bottom portion includes a first retention tray in registration with said first dispensing gap, a second retention tray in registration with said second dispensing gap, and a third retention tray in registration with said third dispensing gap;

wherein said first retention tray projects a first distance beyond said first front wall panel, said second retention tray projects a second distance beyond said second front wall panel, and said third retention tray projects a third distance beyond said third front wall panel;

wherein said second distance is greater than said first distance, and said third distance is greater than said second distance.

3. The apparatus of claim 2 wherein said retention trays each include retention walls and an article-access notch located between said retention walls.

* * * * *